United States Patent [19]

Pozzo et al.

[11] 4,009,073

[45] Feb. 22, 1977

[54] PRODUCTION OF HARDBOARD IN A CLOSED WATER SYSTEM

[75] Inventors: James A. Pozzo, Troy, Mich.; Maxwell M. Yan, Oakville, Canada

[73] Assignee: Abitibi Paper Company Ltd., Toronto, Canada

[22] Filed: Aug. 11, 1975

[21] Appl. No.: 603,686

[52] U.S. Cl. ..... 162/132; 162/135; 162/163; 162/190; 162/206; 162/225

[51] Int. Cl.[2] ..... D21F 11/04; D21F 13/00

[58] Field of Search ..... 162/135, 163, 190, 225, 162/132, 206

[56] References Cited

UNITED STATES PATENTS

| | | | |
|---|---|---|---|
| 2,046,750 | 7/1936 | Mason et al. | 162/163 |
| 2,208,511 | 7/1940 | Ellis | 162/206 |
| 2,495,043 | 1/1950 | Willey et al. | 162/225 |
| 2,802,403 | 8/1957 | Boehm | 162/206 |
| 2,888,376 | 5/1959 | Stewart | 162/225 |
| 2,898,260 | 8/1959 | Berliner | 162/225 |
| 2,918,398 | 12/1959 | Dorland et al. | 162/132 |
| 3,113,065 | 12/1963 | Newton et al. | 162/225 |
| 3,159,528 | 12/1964 | Goss | 162/163 |
| 3,223,579 | 12/1965 | Dorland et al. | 162/225 |
| 3,303,089 | 2/1967 | Roubicek et al. | 162/225 |
| 3,485,714 | 12/1969 | White | 162/225 |
| 3,907,630 | 9/1975 | Selander | 162/190 |

*Primary Examiner*—Robert L. Lindsay, Jr.
*Assistant Examiner*—Peter F. Kratz
*Attorney, Agent, or Firm*—Stevens, Davis, Miller & Mosher

[57] ABSTRACT

Hardboard is produced by a process wherein wood solubles or sugars released principally during the pulp preparation stage are retained in a closed water system by collecting the process waters released during mechanical dewatering of the pulp to form a mat and returning such water to the system. The mat is dried by thermal evaporation with substantial quantities of sugars being deposited on the mat surfaces as a result. The mat is then pressed under conditions such as to cause flowing and caramelization of the surface sugars thus forming a crust or skin of the sugars on the mat surfaces, which sugars improve the board surface characteristics. A paper overlay may be applied to the mat prior to pressing and bonded thereto by the sugars to provide a paper overlaid hardboard.

11 Claims, 2 Drawing Figures

PRODUCTION OF HARDBOARD IN A CLOSED WATER SYSTEM

This invention relates to the manufacture of compressed fibre products, particularly to panel products made from lignocellulosic fibres and commonly termed "hardboard". The invention is particularly concerned with the production of hardboards in a so-called "closed" water system i.e. a system wherein the waters of manufacture or white waters are retained in the system and continually recirculated for reuse.

The prior art has provided a number of basic processes for making hardboard, for example, the wet S-1-S (Smooth-One-Side) process, the wet S-2-S (Smooth-Two-Sides) process and the dry S-1-S or S-2-S fibre process, all of which will be briefly described.

In order to better understand the prior art and the present invention reference may be had to the drawings wherein.

Figure 1:
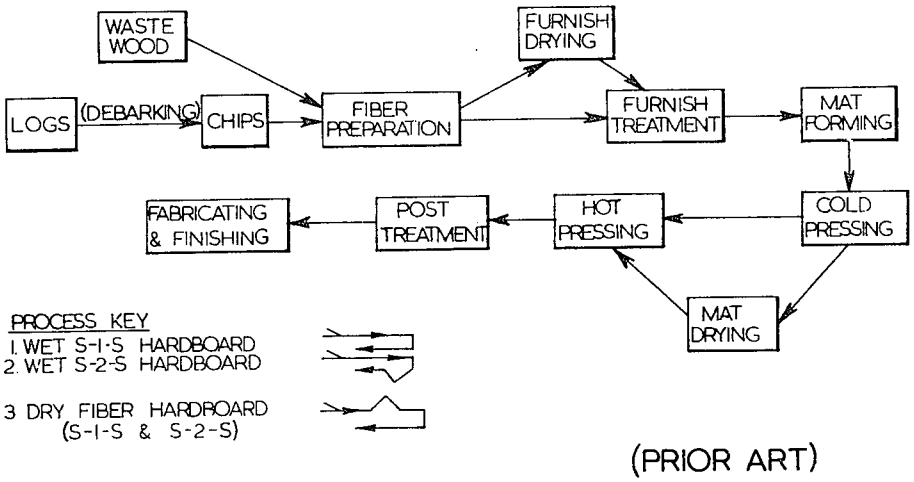
(PRIOR ART) FIG. 1
FIG. 1 illustrates the schematic flows of the major prior art hardboard processes.

With reference to FIG. 1, the wet S-1-S (Smooth-One-Side) hardboard process consists of chipping (where necessary), fibre preparation (usually steam cooking and mechanical refining), washing and chemically treating the furnish (binding resins, sizes, pH adjusting chemicals), forming the wet mat by drainage of an aqueous suspension, partial dewatering by cold pressing, hot pressing the cold pressed wet mat on a wire screen (against a patterned top caul plate where surface embossing is desired), post baking and rehumidifying the hot pressed board in ovens and humidifying chambers, fabricating and decoratively finishing the surface.

Wet process S-2-S (Smooth-Two-Sides) follows the same initial procedures as S-1-S up to the cold pressed wet mat stage but then the mat goes into hot air dryers where the moisture content is reduced to a low value (e.g. less than 1%). The dried mat is then hot pressed at high temperature e.g. 450°–500° F and high pressure e.g. 500–1000 p.s.i. at short cycles, without a backing screen. It then follows the same process flow as the wet S-1-S process for post-treatment, fabrication and finishing.

Dry fibre hardboard (either S-1-S or S-2-S) follows the same general process sequence as wet process S-1-S except that the fibre furnish is dried after preparation from the wood chips and before chemical treatment and mat formation. Fibre handling and mat forming techniques, of course, differ from wet process methods since the fibre is handled in air and not in water.

The present invention is concerned with the second form of process referred to above and provides for the production of high quality hardboard in a closedwater system.

Closed water systems as related to the manufacture of paper and certain hardboards are not, in general, new. For many years it had been common practice to produce hardboards in open-water systems i.e. systems wherein the used process waters are disposed of in one way or another. These effluents, containing relatively large amounts of dissolved materials, principally dissolved wood sugars, plus small amounts of various chemical additives as well as some fibre solids, present a significant pollution problem and many jurisdictions have imposed controls on the manner of disposal permitted; in many cases expensive effluent treatment facilities had to be set up to satisfy the requirements imposed. Since the installation and operating costs of such treatment facilities are substantial, efforts have been and are being made to close these systems wherever possible to eliminate the need for effluent treatment.

The closing of the first form of system mentioned above wherein the wet mat is mechanically squeezed to remove a substantial portion of the water therefrom with the mat being thereafter squeezed in the hot press to substantially complete the removal of the water and compress and consolidate the board is shown, for example, in Canadian Pat. No. 969,689 to Selander and in French Pat. No. 2,212,778 to Isorel. This form of process does not ordinarily present unusual problems since the concentration of wood sugars at the mat surface is seldom great enough, even considering the much higher level of solubles in the process water, to cause sticking of the mat to the press surfaces or surface discolouration of the panels. One of the main reasons for this is that in the S-1-S process the wet mat is subjected to a relatively high pressure initial squeeze during hot pressing which expels a substantial portion of the water in the liquid state along with the dissolved solubles therein out of the mat through the screen side. This flushing action decreases substantially the overall amount of wood solubles in the mat. Another reason is that, after the initial flushing action, evaporation of water from the partially formed board takes place primarily through the lower screen side of the board. Thus any imbalance in solubles concentration tends to be toward the unimportant backside of the board. One possible reason for this is that the topside of the board is rapidly seared and partly sealed by contact with the hot top press platen thus greatly reducing evaporation therethrough and also reducing solubles deposition thereon. In contrast, the situation encountered in the second form of process mentioned above is entirely different. In this process, the mat is air dried to form a bone dry mat which must then be pressed under conditions of sufficient heat and pressure as to activate the bonding constituents in the mat to produce a board having the required density, surfaces of the desired quality, and overall strength. During the air drying process, the exposed surfaces dry first, leaving a surface deposit of any wood sugars which were present in the process waters. These dried or partially dried surfaces act like a wick, drawing further liquid from the core, which, in turn, evaporates and deposits still further sugars on the mat surface. This process continues until the mat is dry with the result being that a very substantial portion of any sugars in the wet mat are deposited on the mat surfaces.

In an open effluent system the total concentration of sugars in the process waters will usually be quite low and thus relatively small amounts of sugars are deposited on the mat surfaces. In spite of this, others, in the belief that the surface sugars were harmful, attempted to reduce surface sugars to a minimum, either by scraping or washing them away from the mat surfaces or by treating or handling the process waters in such a way that most of the dissolved sugars were removed from the process waters prior to the time of formation of the wet mat.

One prior art process for producing panel board in a partly closed system is shown in U.S. Pat. No. 3,159,528 to Goss. Goss produces a low density exterior structural board and employs mat drying and subsequent hot pressing. Hot press conditions are typically 310° F. for 1 to 10 minutes retention time at 5 to 10 pounds/square inch pressures, with board caliper and hence density being controlled at a relatively low level through the use of spacers or stops between the press platens. The resulting board has a specific gravity of about 0.35 to 0.55 which is slightly higher than the specific gravity of conventional insulation board sheathing. The Goss patent makes no mention of the effect of any increased concentration of sugars on the mat surface, which is not surprising, since, although the Goss patent does employ a form of "closed circuit" for certain of the process waters, the closed circuit is provided only in the area of mat formation and cold pressing — the major portion of the solubles, created and extracted during the pulp preparation stage, does not enter the closed circuit portion. In the Goss process, the steamed and digested wood chips are squeezed to remove spent liquor therefrom; then they are boiled in water and squeezed again. Both of these treatments are believed to remove the bulk of the solubles before the closed circuit portion of the process is reached. Thus, during the subsequent mat drying stage, few wood sugars remain to migrate to the surface. Furthermore, under the low press temperatures which Goss uses, any small amounts of wood sugars on the mat surfaces would not flow or caramelize and thus would have virtually no influence on board surface properties.

A key feature of the present invention is that the wood solubles released principally during the pulp preparation stage are retained in a closed water system, (i.e. no effort is made to remove the solubles as by aeration or biological attack), with such solubles, consisting mainly of sugars which migrate to the mat surfaces during the air drying or thermal evaporation stage, being retained on the dried mat surfaces, (i.e. none of the sugars are washed or scraped away from the mat surfaces) with such wood sugars flowing and caramelizing at the board surface under the relatively high temperature conditions encountered in the press. It has been found, surprisingly, that the caramelized sugars on the board surface are not detrimental to board surface quality but, in fact, serve to significantly improve the board surface characteristics as will be more fully described hereafter.

Thus, in one aspect, the present invention provides a process of manufacturing hardboard including the steps of: preparing a pulp stock comprising a suspension of lignocellulose fibres in water, said water also containing therein dissolved solubles which consist essentially of wood sugars released primarily during the pulp stock preparation, mechanically dewatering said pulp to form a wet mat, drying the wet mat by thermal evaporation, and subsequently pressing the dry mat between the forming surfaces of a heated press to form a hardboard, characterized in that the solubles released during said pulp stock preparation are retained in the water in which said fibres are suspended with said solubles-containing water which is separated from said pulp during said mechanical dewatering thereof being collected and fed back to join the water which is used in the process, including that used to suspend the pulp, thereby to provide a closed water process with said water thereby being enriched principally by the dissolved wood sugars therein, a substantial portion of the dissolved wood sugars in said wet mat being deposited on the surfaces of said mat during said drying of the mat by thermal evaporation, said sugars being retained on the surfaces of the dry mat and said pressing of the dry mat to form said board being carried out with the forming surfaces of the press at a temperature sufficient as to cause flowing and caramelization of the sugars retained on the major surfaces of the board immediately adjacent to or in contact with the press forming surfaces to thus provide a skin or crust of said sugars at said major surfaces of the board.

In a further aspect of the invention said pressing of the mat is carried out with the press forming surfaces at a temperature not less than about 425° F. Preferably, said press forming surfaces are at a temperature from about 450° to about 500° F.

In a typical operation according to the invention a pressure from about 150 pounds per square inch to about 1000 pounds per square inch is applied to said mat during pressing to form said board.

Further, in the closed circuit process of the invention, the wood sugars are present in the pulp stock typically in an amount of from about 2.5 to about 10% by weight.

A further feature of the invention includes providing a release agent which interacts between the press surfaces and the mat surfaces to inhibit sticking of said mat surfaces to the press surfaces during said pressing step. Said release agent may be applied as a coating to the major surfaces of the mat prior to the pressing step. In cases where the drying of the mat is carried out in two stages, the release agent is preferably applied to the mat prior to the second drying stage. The release agent may advantageously be combined with a catalyzed water-reducible thermosetting vinyl latex emulsion.

The present invention enables the production of hardboards having a wide range of densities, typically in the range of about 0.50 to about 1.20 specific gravity, with 0.85 being a preferred average specific gravity, such board having surface qualities in terms of surface smoothness and toughness which make it suitable for use as an interior substrate capable of being painted in a decorative manner.

Thus, in a further aspect of the invention there is provided a hardboard panel including a core of heat and pressure bonded lignocellulose fibres, said core defining a pair of opposed major surfaces and wherein a skin or crust of caramelized wood sugars is disposed at said major surfaces.

A still further aspect of the invention relates to the discovery that the wood sugars in the mat surface make a very effective adhesive where it is desired to laminate an overlay of paper to one or both of the hardboard surfaces. Accordingly, a paper overlay may be applied to the mat surface before the press itself or the press dryer and the mat pressed as described above. The paper surface can be plain or decoratively printed. The overlay paper, in addition to providing a paper surface on the panel, provides easy release of the mat from the press surface contacting the same. Additional characteristics of this aspect of the invention are set forth hereinafter.

A typical process according to the invention will now be described with reference being had to FIG. 2 which illustrates a closed water system capable of carrying out the process of the present invention.

Figure 2:
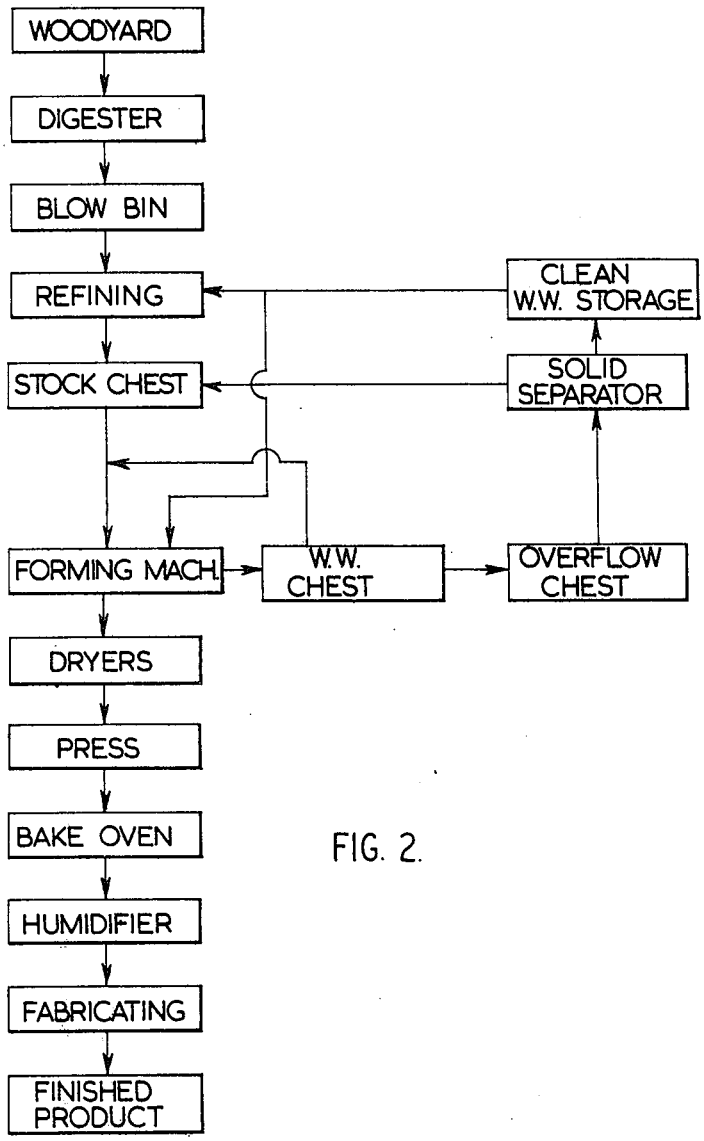
FIG. 2 illustrates a "closed water" process as used in connection with the present invention.

As shown generally in FIG. 2 wood chips travel from the woodyard to a digester and thence into a blow bin. From there the chips are refined and pass into the stock chest which provides the feed for a conventional hardboard forming machine which forms a wet mat. The wet mat then passes into hot air dryers and the moisture is removed therefrom. The mat is then hot pressed and thereafter baked to complete the curing of the board. The board is subsequently humidified and then fabricated and finished as desired. FIG. 2 clearly illustrates the handling of the process water or white water. Excess white water passes from the white water chest to an overflow chest and thence through a solids separator which removes most of the fibre solids. The solids are directed back to the stock chest to become part of the stock feed to the forming machine. The cleaned white water is directed to a storage basin from where it is pumped back to the process e.g. to the refiner and the forming machine headbox as required. No water is discharged to the surrounding environment.

The digesting and refining steps are entirely conventional in nature and need not be described in detail. The following general description of a typical stock preparation method will serve to give those skilled in the art the necessary information. One well known refining process involves the use of a so-called "rapid cycle" digester. The rapid cycle digester effects the steaming of wood chips in a closed vessel from 1½2 min. to 10 min. at pressures varying from 50 to 250 psi, depending on wood species, fibre quality desired, etc. Generally speaking no chemicals are added to assist in wood cooking. Also, in the rapid cycle system, no free water is usually present, as the moisture content of the cooked chips is approximately the same as the raw wood; i.e. no water is present in the blow bin and hence no digester water circuit is required. Virtually all of the solubles created during the cooking stage are retained in the moisture present in the chips themselves and they are subsequently liberated in the refining stage.

With respect to refining, the cooked woods are fiberized in conventional atmospheric refining equipment, eg. by "Bauer Refiners". The wood is force fed to the center of oppositely rotating discs, in the presence of some carrier water, and ground to a fibrous state having a freeness level usually in the range of 10 to 50 secs. Williams freeness. In some cases a secondary refining treatment is given to the primary refined material to improve fiber uniformity.

The refined feedstock together with all the wood solubles liberated during at least the refining stage is then fed to the stock chest, the latter supplying the headbox of the forming machine.

a. Headbox Ingredients:

A feed consistency of approximately 1 and 1½2% fiber solids in water is typical and comprises mainly lignocellulose fiber with small amounts of oxidizable oil binders (such as linseed oil) in an amount of approximately 1% based on bone dry fibre weight, and small amounts of a binder precipitant such as alum (aluminum sulphate) or ferric sulphate in a rate of 1½2 to 1% of fibre weight. The foregoing are typical figures for fibre content, binders and additives. Variations are common when special end properties are needed such as improved strength and/or water resistance in which event binder content could be increased to 4%, and precipitant to 2% of fibre weight. Supplemental sizing agents such as emulsified or dispersed crude wax or rosin are sometimes also added as beater additions in rates commonly of 1½4% to 1% of fibre weight.

With respect to wood solubles at this point, a range of from 25,000 to 50,000 parts per million (ppm) in the effluent or white water chest is typical, with an average figure of around 38,000 ppm (3.8%). However, in some cases, wood solubles can go as high as 100,000 ppm i.e. 10% by weight. In contrast, a typical range for a conventional open effluent system would be approximately 2,000 to 3,500 ppm (0.20 to 0.35%) of solubles. The solubles consist primarily of wood sugars and the approximate composition of the wood sugars involved is set out below. Excluding water hardness and various basic and acidic ions, a typical headbox feed composition by weight is:

| | |
|---|---|
| Fiber | 1.50% |
| Binder Oil (1%) | 0.015% |
| Precipitant (%%) | 0.011% |
| Wood Sugars | 2.5–5.0% |
| Water | remainder |
| Total | 100% |

The composition of the soluble sugars in the closed water system is not known precisely nor is the precise composition important from the point of view of the present invention. However, an approximate composition can be obtained from a knowledge of the composition of wood and of its behaviour when heated with water in liquid or steam form. As is well known about three-quarters of wood consists of polymerized sugars or sugar-derived molecules, called polysaccharides. These exist in two major forms - cellulose and hemicellulose. Both, but particularly the hemicellulose, are in part hydrolyzed or broken down to lower molecular weight polysaccharides and finally to simple sugars when heated with water or steam. The main simple sugars produced are glucose, xylose, mannose, arabinose and galactose; some sugar derivatives, such as glucuronic acid and furfural, as well as other simple materials such as acetic and formic acid are also formed. The types and amounts produced will vary with the wood species and the cooking conditions. In southern pines, for example, the major sugars are most probably mannose, xylose and glucose; there may also be small proportions of non-sugar materials arising from oleoresinous materials.

b. Mat Formation:

The foregoing dilute 1 and ½ fibre solids slurry is mechanically dewatered to about 40-45% solids in a two-stage operation prior to drying. The "white water" or process water is collected and fed back into the system as described above. In a typical operation the headbox pulp is picked up on a twin cylinder "Karhula" former on which the stock is dewatered to about 25–30% solids. The partially dewatered mat is continuously transferred to a four roll press section where the mat is further dewatered to 40–45% solids. It is considered that the type of forming machine is unimportant to this invention as a typical Fourdrinier or Oliver former would work equally as well. The basis weight of the sheet, usually expressed in pounds of dry product per thousand square feet, determines the ultimate board grade; i.e. 1¼4' or 1⅛8' caliper hard-board. Typical weights range from 600 to 1500 lbs/MSF (thousand square feet).

c. Drying:

The partially dewatered mat is fed to a gas or steam heated, or combination of the foregoing, dryer where the mat is dewatered by means of thermal evaporation to about 90% to 98% solids content. This first stage drying thus removes most, but not all, of the water, i.e. a small amount is left in the mat. Dryer temperatures range from 275° to 450° F. and vary throughout the dryer to maximize drying rate. The drying time is about 1 and 1½2 to 2 hours. It is in this first stage dryer where the wood solubles tend to migrate toward and concentrate on the mat surface. Under normal dryer operating conditions, the exposed surfaces will dry first, leaving a deposit of sugars reflecting the high concentration of solubles in the original mat water or white water. The dried or partially dried surface now acts like a wick, drawing further liquid from the wet core, which in turn evaporates leaving an additional deposit of solubles on or near the surface. This process continues for a period of time long enough to deposit a markedly disproportionate share of sugars at the mat surfaces. Of course, the greater the sugar content in the process water, the greater the final sugar deposit on the surface. Proof of the high sugar content on the mat can be displayed by washing a surface section of a typical mat with warm water, followed by drying. The resulting washed section will be distinctly lighter in color than the unwashed section. This color difference is also clearly reflected in the pressed board.

In the second stage drying, the small amount of water left from the first stage is removed. The bone dry mat can now be hot pressed without incurring "blows" or delamination due to trapped water vapor. Dryer temperature in this stage is about 300° F. and the time about 1 and 1½2 hours. It is just prior to this drying stage that a water reducible press release agent may be applied to both surfaces using the dryer to evaporate the water and cure the resin. However, the invention is not to be limited in any way to this technique for accomplishing release in the hot press.

d. Press Release Means or Agen.s:

Those skilled in the art will realize that a press release agent is not normally required in conventional open white water systems where the pulp is washed or treated so as to purposely lower the wood solubles level. In this case the sugar accumulation on the mat surface is too low to cause clinging in the hot press. In the closed process of the present invention, the vastly higher sugar content usually requires the use of press release means or agents.

There are a number of coatings and techniques for providing press release where sticky mats are encountered in S-2-S production. These include:

1. Treating the caul or platen pressing surfaces with a release agent such as "Teflon" which is known for its antistick properties.

2. Covering the mat with a release paper.

3. Applying inert silica and/or clay coatings to the mat to physically separate the mat and pressing surfaces.

4. Applying commercially recommended liquid formulations or resins to the mat to effect release.

Another aspect of the invention which is described hereinafter involves applying an overlay paper to the mat prior to pressing which overlay becomes bonded to the board surface by the action of the sugars during pressing.

It has been found that, for ease of application, handling properties, cost, release effectiveness and for imparting improved surface finishing properties in terms of paint "hold out", a mat coating supplied by Glidden-Durkee, Division of SCM Corp. under the trademark "Fibertite" is highly desirable for this purpose. It is designed to be applied to the mat before the second drying stage. Effective coverages are 1–5 lbs. solids/thousand square feet (MSF) of surface. This coating is a non-blocking, water-reducible, thermosetting vinyl latex emulsion containing an aminoplast and a release agent. This particular one package "pre-catalyzed" clear prepress coating has the product designation EXM-71138A and should be applied to the mat as an airless spray. The viscosity of the coating is 75–80 KU(Krebs Units) and the weight per gallon is 8.84 lbs. The non-volatiles (N.V.) by volume are 29.9% and by weight 34.2%.

e. Hot Pressing:

The pressing procedure is generally the same as that typically used for S-2-S operations i.e. with press temperatures not less than about 425° F. and preferably from about 450° to 500° F. with the press being operated at a pressure from about 125 to 1000 pounds/square inch and preferably from about 400 to about 800 pounds per square inch with the total press cycle time being selected to be in accordance the desired temperatures and pressures. A typical pressing cycle at 485° F. press platen temperature would be:

1. 0 to 600 psi on mat in 45 secs., which represents the pressure build up stage.

2. At 600 psi for 65 secs., which represents the high pressure holding stage.

3. 600 psi to 0 psi in 10 secs., which represents the pressure release stage.

4. Total in-press time — 2 minutes.

The press cycle must provide sufficient heat and pressure over a sufficient period of time as to allow the bonding constituents in the wood to melt or flow and bind the wood fibres together and to caramelize the surface sugars to provide the desired surface properties. These press conditions must also serve to provide the board of the desired density e.g. a specific gravity from about 0.50 to about 1.20 with the preferred specific gravity being in the order of 0.85.

It has been observed that hardboard pressed from high solubles content mat in accordance with the invention has a very dark, hard skin on both surfaces which is attributable to the caramelization of partial charrring of sugars when subjected to the press temperature typically encountered. This skin or crust is thin and can be scraped away with a sharp edge to expose the much lighter core fibres underneath. The skin is clearly composed of soluble wood sugars because, as described previously, a washed mat surface will, after pressing, exhibit a much lighter shade. The above described Glidden "Fibertite" coating will impart a slightly darker shade by itself, although it is in no way involved wih the marked dark shading attributable to the sugars.

Extensive tests have revealed that the flowing and caramelization of the sugars on the board surface is primarily dependent on press temperatures, with pressing pressure being of secondary importance. That is, the pressure is primarily selected to provide the desired board density. Stops or spacers may also be used in the press to control density. Press cycle time is dependent on a wide variety of factors including pressure and temperature. Those skilled in the art will readily be able to determine the shortest cycle time needed to produce the desired results. As noted previously, the minimum press temperature required to produce flowing of the sugars on the board surface and caramelization of same is about 425° F. However, better results are obtained at the higher temperatures given above eg. from 450° to about 500° F.

It is also noted here that the term "caramelize" or "caramelization" is used herein to express the chemical and consequent physical effects of heat on the solubles. The elevated press temperature causes both degradation and recombination or polymerization of the active chemical species produced, these reactions involving free radical as well as other reaction mechanisms. These changes create chromophoric groups which cause the colour darkening and produce chemical changes such as improved solubles flow and decreased solubility, which serve to improve the board surface.

f. Post-Press Operations:

To further improve the physical and surface finishing properties of S-2-S hardboard, it is conventional to treat or coat the hot out-of-press board with various thermosetting and/or oxidizable resins or oils; i.e., linseed, tung, petroleum hydrocarbon blends, etc. Depending on the degree of property improvement desired, coverages can vary from 2 to 10 lbs./MSF of surface area. The treated board is normally then heat treated in ovens for 2 and ½ to 4 hours at 280° F. to assist in curing out the tempering oil, as well as the integral oil binders. This bake treatment will also improve physical (though not surface) properties of untreated board as well. At this point, the board is bone dry and must, for most end uses, be moisturized or humidified to prevent buckling or warping in subsequent finishing and field installation operations. Humidification is normally accomplished in-line, after baking, by subjecting the board to very hot, humid air. Conditions in the chamber approach 95% R.H. (relative humidity) and 200° F for 2 and ½ to 8 hours duration. The board absorbs moisture from 2 to 9% by weight of the board, averaging about 4%.

g. Finishing Operations (continuous in-line operation):

One of the major uses of S-2-S hardboard is as a substrate for various finishing operations, primarily for interior decorative wall paneling. Hardboard is superior to many other materials for this purpose because of its smooth, uniform, tight surface.

Most panel board finishing operations comprise the following steps:

1. Sanding — removes pimples, high spots; improves bond of subsequent coatings.

2. Filling — a highly pigmented coating is applied to the bare substrate, and then immediately the excess is wiped off by a reverse roll action or by doctor blade. The purpose is to fill any tiny holes, cracks, depressions, etc. present in the surface, and to key or bond subsequent coatings better to the board. Sometimes the coating is baked slightly.

3. Some lower quality surfaces or materials will require repetition of steps (1) and (2) one or more times.

4. Striping — The scored or embossed plank grooves are spray coated, and then heated by infrared radiation.

5. First groundcoat — A colored pigmented coating is direct roll coated to provide the base tone of the final print. Sometimes a short bake is used to partially set this film.

6. Second groundcoat — The same coating is reapplied to provide total substrate hiding and pigmentation.

7. Groundcoat Bake — The foregoing groundcoat is oven baked at 350°–450° F. for approximately 20 to 30 secs.

8. Printing — A multi-stage roll printing operation where the undertone and several individual colored "keys" are applied, which combine to form the finished pattern.

9. Topcoating — A clear protective topcoat lacquer is applied by curtain or roll coater.

10. Topcoat Bake — Comprises a flash zone for about 10 secs., followed by a high temperture bake of 300° F. for 30 secs. After cooling and grading, the board is unitized for shipment.

h. Characteristics of Core:

It is generally intended to use the product in question as a core or substrate for in-line finishing to produce various decorative wall panels of nominal ⅛ inch and ¼ inch thickness, although other end uses are possible. For example, the bare board could be sold for cut-to-size uses in automotive or furniture assembly operations.

A typical test result for hardboard manufactured according to the procedure described above is:

| Caliper | Air Dry Weight | Modulus of Rupture | Density |
|---|---|---|---|
| 0.200" | 930 lbs/MSF | 3,325 psi | 56 Lbs/cubic ft |
| Specific Gravity | | Water Absorption-24 hr. | |
| 0.90 | | 25% weight - 13% thickness swell | |

i. Test Procedures:

A number of tests were designed to demonstrate the effects of the wood sugars on the surface qualities of the hardboard. In order to prepare for this test one-half of one surface of a fully dried unpressed mat sample was washed by allowing warm tap water to run over the surface involved for a period of 20 to 25 seconds. This technique proved to be very effective in dissolving and rinsing off a very substantial portion of the concentrated wood solubles present on the mat surface. The mat was then oven dried to bone dryness prior to hot pressing, as described previously. To obtain a thoroughly washed area to contrast with the original unwashed surface, this washing step was repeated once more on the same half surface after having dried the first rinse. The mat was then again oven dried to bone dryness. It is stressed at this point that the washing is being conducted on the thick, low density, mat and not on the high density pressed board. The reason for this is that on the mat, the sugars or solubles are still relatively water soluble and amenable to removal with the above described treatment.

A description of the several tests and their significance is given below. In several of these tests reference is made to the "masking tape pull test". This is a test to determine the surface integrity of the board. In order to conduct this test, a strip several inches long of regular masking tape or draftsman's tape is pressed onto the board surface using relatively light "finger pressure". One end of the masking tape is then pulled away from the board surface, generally at right angles thereto, and the quantity of fibre adhering to the masking tape is noted. In boards having poor surface integrity, various substantial quantities of fibres will be lifted off; in cases of boards with good surface integrity, no fibres at all will be lifted off or so few will be lifted off that they are scarcely visible to the naked eye.

Test No. 1

The mat, having one-half of its surface area treated as described above, was observed in order to determine qualitatively the effect of the washing on the colour of the mat. The double rinsed area of the mat was a very light brown or beige shade while the unwashed area was several shades darker i.e. medium brown. Since the depth of colouring is an indication of the amount of wood solubles remaining on the surface, this test demonstrated that at least a major portion of the surface solubles or sugars were removed as a result of the rinsing technique.

Test No. 2

The above described mat, having washed and unwashed areas, was then pressed under the conditions previously described to obtain a hardboard sample. No coating or release agent was applied to the mat prior to the pressing operation. Press release was obtained by coating the caul plates or pressing plates with a commercial release agent. The resulting hardboard was then observed and it was noted that the unwashed area having the high concentration of sugars on the surface had, under the influence of the temperatures encountered in the press, taken on a much darker colour i.e. a very dark brown shade; again, the washed surface area was several shades lighter in colour i.e. a medium brown shade, thus again reflecting the lower sugar concentrations thereon. In order to compare the surface integrity of the washed and unwashed areas of the board, the masking tape pull test was applied to both areas. On the unwashed area having high sugar concentrations, a negligible number of fibres were pulled away from the surface by the masking tape thus demonstrating good surface integrity. On the washed area, whole surface areas were completely removed by the masking tape thus demonstrating poor surface integrity i.e. poor fibre bonding at the surface.

Test No. 3

Test No. 2 was repeated except that the Glidden Fibertite prepress release coating was applied to the mat prior to hot pressing. The colours of the two areas were not significantly affected by this except that the unwashed area showed a slightly darker shade. The masking tape pull test was applied to both areas with essentially the same results as described above in connection with Test No. 2. Thus the use of a prepress coating does not appear to help surface integrity or surface fibre tensile strength and it follows that the surface sugars are the predominant factor in the good surface integrity observed on the unwashed area.

Test No. 4

Essentially the same procedure was used as in Test No. 2. The purpose of this test was to illustrate the superior paint hold-out properties given to the panel by virtue of the caramelized sugars on the surface. An equal amount of lacquer or solvent based paint was applied to both areas of the hardboard by means of a "spray bomb". On the unwashed surface, the dark surface was almost totally masked by a single layer of paint while on the washed surface, the major portion of the paint was absorbed into the surface. The test proved that the caramelized surface sugars are capable of providing a distinct sealing action on their own, preventing the absorption of typical coatings. This is an important advantage where the substrate is to be decorated in commercial finishing lines. Economies in paint usage are clearly implied where the substrate has to be totally masked.

Test No. 5

Essentially the same procedure was followed as in Test No. 3 i.e. the prepress Fibertite release coating was applied to both areas of the mat prior to pressing. A single coating of paint was then applied to both areas as described in Test No. 4. This test indicated that the coating further improves paint holdout and uniformity for both washed and unwashed areas although the unwashed surface with the high concentration of caramelized sugars thereon is still significantly better than the washed surface insofar as paint holdout is concerned.

Test No. 6

Essentially the same procedure was carried out as in Test No. 3 except that the washed area received only a single light water rinse instead of two rinses. A tape pull test was conducted on both surfaces. A negligible number of fibres were removed from the unwashed area by the masking tape while a significant number of fibres were removed from the surface by the tape on the washed area; however the number of fibres removed was significantly fewer as compared with Test No. 3 thus demonstrating that surface integrity and surface fibre tensile strength are directly related to the concentration of wood solubles on the panel surface.

Test No. 7

A sample of hardboard was obtained from a mill having an open effluent system and low solubles content. The hardboard was prepared using the same techniques as described herein but no pre-press coatings or post-press oil tempering treatments were given to the board. The masking tape test was applied to the surface and serious surface failure was indicated, as bad as, and possibly worse than the surface failure demonstrated by the washed surface described in Test No. 2.

Test No. 8

This test was the same as No. 7 above except that the hardboard sample received a conventional post-press oil tempering treatment. The masking tape test exhibited slight fibre pull. The degree of failure, thought slight, was still worse than that of the untempered caramelized surface described in Test. No. 2 which showed virtually no failure. The wood sugars therefore are toughening the surface at least to the extent that a conventional post-press tempering operation will in an open, low solubles content hardboard production operation.

In summary, it is evident that very beneficial properties are imparted by the wood sugars when they are retained on the board surface in sufficient amounts and used in a wet-dry hardboard process as described herein. Both surface integrity and paint holdout — two of the most important properties required in a finishing grade hardboard substrate — are directly and markedly improved. The improvements noted imply direct economies in that it is conceivable that the post-press tempering operation for conventional hardboard is unnecessary and that distinctly less paint is required for finishing.

A further aspect of the invention, as briefly mentioned previously, concerns the use of the wood sugars on the mat to effect binding of a paper overlay to one or both surfaces of the board. Basically it has been discovered that the surface sugars make a very effective adhesive where it is desired to laminate a piece of paper to one or both hardboard surfaces. This aspect of the method involves applying a piece of overlay paper to the mat surface — either before the press dryer or just before the press itself — and subsequently hot pressing the paper-mat laminate in the press under the press conditions described previously. The exposed paper surface can be either plain or decoratively printed. In either case this paper surface provides the desired release from the press, rather than the Glidden pre-press release or other release means described previously. The release agent would still be required on the unprotected or non-overlaid side of the board.

One press release means described previously concerns the use of a "release" paper. Conventional release papers are very smooth, sealed, non-sticking parchment-type sheets designed to be removed from the board somewhere after the press, and subsequently discarded. This form of release sheet has release properties on both sides; i.e., it releases from the board and from the press platen.

In contrast to the above noted release paper, the paper overlay to be used in accordance with this aspect of the invention is a typical open groundwood or newsprint-type sheet which does not offer any resistance to lamination in the presence of an adhesive on its backside but which still provides release on its exposed side. The platen release mechanism is simply that due to the masking or covering of the sticky sugars by the overlay papers.

A very important feature is seen to reside in the sticky nature of the sugars, and the fact that they are not activated until exposed to the very high temperatures of the hot press. The presence and characteristics of these sugars offers several advantages, as follows. They provide an effective, natural occurring wood adhesive at no cost and with no application problems inherent in a conventional adhesive system. The deposition, concentration and location of this adhesive is a natural consequence of the closed process invention previously described. The sugars effectively bond open paper overlays such as newsprint-type sheets, and this offers an approach to manufacturing a printed, toned, or variously decorated S-2-S type hardboard wherein the decorative surface is supplied by the paper overlay. Previous research in this area revealed that selection of a workable conventional adhesive system for S-2-S type hardboards was extremely difficult because of the stringent temperature sequence of the operation; i.e., the high pre-dryer temperature (300° F.) prematurely set most adhesive systems, while the hot press degraded others. In contrast, the surface wood sugars flow and bond at precisely the right point. Without the sugars, such as in regular low solubles open effluent mat, such overlay papers do not bond without the assistance of a foreign external adhesive.

The surface integrity properties provided by the sugars as previously described and still important as the paper overlay properties still reflect the improved, hard surface immediately underneath.

After pressing, the panel is subjected to the usual post baking and humidifying operations as described above.

The paper overlaid surface of the hardboard product is, of course, not subjected to the same finishing operations as described above, but rather is decorated as desired and/or treated with clear or pigmented protective coatings.

What is claimed is:

1. A process of manufacturing hardboard including the steps of: preparing a pulp stock comprising a suspension of lignocellulose fibres in water, said water also containing therein dissolved solubles which consist essentially of wood sugars released primarily during the pulp stock preparation, mechanically dewatering said pulp to form a wet mat, drying the wet mat by thermal evaporation, and subsequently pressing the dry mat between the forming surfaces of a heated press to form a hardboard, the improvement comprising: retaining the solubles released during said pulp stock preparation in the water in which said fibres are suspended collecting said solubles-containing water which is separated from said pulp during said mechanical dewatering thereof and feeding said solubles-containing water back to join the water which is used in the process, including that used to suspend the pulp, thereby to provide a closed water process with said water thereby being enriched principally by the dissolved wood sugars therein such that said wood sugars are present in the pulp stock in an amount of from about 2.5 to about 10% by weight, a substantial portion of the dissolved wood sugars in said wet mat being deposited on the surfaces of said mat during said drying of the mat by thermal evaporation, retaining said sugars on the surface of the dry mat, and effecting said pressing of the dry mat to form said board while maintaining the forming surfaces of the press at a temperature sufficient as to cause flowing and caramelization of the sugars retained on the major surfaces of the board immediately adjacent to or in contact with the press forming surfaces to thus provide a skin or crust of said sugars at said major surfaces of the board.

2. The process according to claim 1 wherein said pressing of the mat is carried out with the press forming surfaces at a temperature not less than about 425° F.

3. The process according to claim 2 wherein said press forming surfaces are at a temperature from about 450° to about 500° F.

4. The process according to claim 2 wherein during pressing, a pressure from about 150 pounds per square inch to about 1000 pounds per square inch is applied to said mat to form said board.

5. The process according to claim 1 wherein wood sugars are present in the pulp stock in an amount of from about 2.5 to about 5% by weight.

6. The process according to claim 1 including providing a release agent which interacts between the press surfaces and the mat surfaces to inhibit sticking of said mat surfaces to the press surfaces during said pressing step.

7. The process according to claim 6 wherein said release agent is applied as a coating to the major surfaces of the mat prior to the pressing step.

8. The process according to claim 7 wherein said drying of the mat is carried out in two stages with said release agent being applied to the mat prior to the second drying stage.

9. The process of claim 1 wherein said pressing of the mat consolidates the mat sufficiently as to provide a board having a specific gravity of not less than about 0.50.

10. The process of claim 1 wherein said pulp stock also contains a binding agent to enhance the bonding of the fibres and consolidation of the board during said pressing.

11. The process according to claim 1 further including applying an overlay paper to a major surface of the dry mat prior to said pressing, with said wood sugars on the mat surface adjacent the overlay paper further acting to bond the paper overlay to the board surface during said pressing.

* * * * *

UNITED STATES PATENT OFFICE

CERTIFICATE OF CORRECTION

Patent No. 4,009,073 Dated February 22, 1977

Inventor(s) James A. POZZO et al

It is certified that error appears in the above-identified patent and that said Letters Patent are hereby corrected as shown below:

Column 1, line 58, change "closedwater" to --- closed water---;

Column 1, line 60, insert quotation marks around "Closed";

Column 1, line 63, insert quotation marks around "open-water";

Column 2, line 7, insert quotation marks around "close";

Column 2, line 10, insert quotation marks around "closing";

Column 2, line 58, insert quotation marks around "open";

Column 4, line 17, after "450°" insert --- F. ---;

Column 4, line 67, insert quotation marks around "closed";

Column 5, line 28, change "1 1/2 2" to --- 1/2 ---;

Column 5, line 54, change "1 1/2 2" to --- 1/2 ---;

Column 5, line 60, change "1 1/2 2" to --- 1/2 ---;

Column 6, line 2, change "1 1/2 4" to --- 1/4 ---;

Column 6, line 9, insert quotation marks around "open";

Column 6, line 50, after "1/2" insert --- % ---;

Column 6, line 65, change "1 1/4 4" to --- 1/4"---;

Column 6, line 65, change "1 1/8 8" to --- 1/8"---;

UNITED STATES PATENT OFFICE

CERTIFICATE OF CORRECTION

Patent No. 4,009,073 Dated February 22, 1977

Inventor(s) James A. POZZO et al

It is certified that error appears in the above-identified patent and that said Letters Patent are hereby corrected as shown below:

Column 7, line 9, change "11/22" to --- 1/2 ---;

Column 7, line 34, change "11/22" to ---1/2---;

Column 7, line 42, insert quotation marks around "open";

Column 7, line 47, insert quotation marks around "closed";

Column 8, line 21, after "450°" insert --- F. ---;

Column 8, line 25, after "accordance" insert --- with---;

Column 8, line 57, change "wih" to --- with ---;

Column 11, line 46, insert quotation marks around "Fibertite";

Column 12, line 38, insert quotation marks around "open";

Column 12, line 45, insert quotation marks around "washed";

Column 12, line 51, change "thought" to --- though ---;

Column 12, line 57, insert quotation marks around "open";

Column 13, line 17, insert quotation marks around "Glidden";

Column 13, line 29, insert quotation marks around "release";

Column 13, line 31, insert quotation marks around "open";

Column 13, line 47, insert quotation marks around "closed process";

UNITED STATES PATENT OFFICE

CERTIFICATE OF CORRECTION

Patent No. 4,009,073 Dated February 22, 1977

Inventor(s) James A. POZZO et al

It is certified that error appears in the above-identified patent and that said Letters Patent are hereby corrected as shown below:

Column 13, line 48, insert quotation marks around "open";

Column 13, line 62, insert quotation marks around "open effluent";

Column 13, line 66, change "and" to --- are ---; and

Column 14, lines 35 and 36, change "surface" to --- surfaces ---.

Signed and Sealed this

Twenty-first Day of June 1977

[SEAL]

*Attest:*

RUTH C. MASON
*Attesting Officer*

C. MARSHALL DANN
*Commissioner of Patents and Trademarks*